US005558429A

United States Patent [19]

Cain

[11] Patent Number: 5,558,429

[45] Date of Patent: Sep. 24, 1996

[54] PORTABLE LIGHTING DEVICE

[76] Inventor: Scott Cain, 157 Peter Ct., Unit C, Bartlett, Ill. 60103

[21] Appl. No.: 258,866

[22] Filed: Jun. 13, 1994

[51] Int. Cl.[6] ..... F21V 33/00

[52] U.S. Cl. ..... 362/155; 362/94; 362/191; 362/276; 362/802; 200/61.83

[58] Field of Search ..... 362/94, 155, 156, 362/191, 205, 206, 276, 802; 200/61.83

[56] References Cited

U.S. PATENT DOCUMENTS

| | | | |
|---|---|---|---|
| 1,309,541 | 7/1919 | O'Neel | 362/154 X |
| 1,375,341 | 4/1921 | Wizner | 362/155 |
| 1,437,023 | 11/1922 | Schneider . | |
| 1,531,288 | 3/1925 | Johnston | 362/156 X |
| 1,906,131 | 4/1933 | Baylis | 362/94 X |
| 2,156,462 | 5/1939 | Schulte | 362/94 X |
| 2,276,370 | 3/1942 | Conrad | 362/154 |
| 2,436,088 | 2/1948 | Bessler et al. | 362/191 X |
| 2,477,884 | 8/1949 | Jackson | 362/802 X |
| 2,517,914 | 8/1950 | Nowaczek | 362/155 |
| 2,644,882 | 7/1953 | Voda | 362/155 X |
| 2,751,489 | 6/1956 | Cole | 362/154 X |
| 2,801,330 | 7/1957 | Gay | 362/154 |
| 2,933,844 | 4/1960 | Seigle | 43/17 |
| 2,947,105 | 8/1960 | Lagios | 362/203 X |
| 3,229,084 | 1/1966 | Bates | 335/153 |
| 3,239,658 | 3/1966 | Castaldo | 362/155 |
| 3,244,871 | 4/1966 | Feldman | 362/203 X |
| 3,404,267 | 10/1968 | Zucker | 362/154 |
| 3,457,368 | 7/1969 | Houcke | 335/153 |
| 3,787,677 | 1/1974 | Molitor | 362/100 |
| 3,921,108 | 11/1975 | O'Connor | 335/153 |
| 3,938,132 | 2/1976 | Cunningham | 340/321 |
| 4,149,223 | 4/1979 | Moberly | 362/156 |
| 4,168,411 | 9/1979 | Peck | 200/61.62 |
| 4,178,626 | 12/1979 | Marcus | 362/133 |
| 4,210,888 | 7/1980 | Holce | 335/207 |
| 4,316,239 | 2/1982 | Cass et al. | 362/155 |
| 4,332,007 | 5/1982 | Gibstein et al. | 362/200 |
| 4,442,478 | 4/1984 | Stansbury | 362/191 |
| 4,571,740 | 2/1986 | Kirby et al. | 455/344 |
| 4,577,475 | 3/1986 | Herrera | 62/457 |
| 4,638,412 | 1/1987 | Weigart | 362/156 |
| 4,755,915 | 7/1988 | Rogers | 362/155 |
| 4,823,241 | 4/1989 | Trattner | 362/183 |

FOREIGN PATENT DOCUMENTS

| | | |
|---|---|---|
| 1085542 | 2/1955 | France . |
| 485272 | 5/1938 | United Kingdom . |

*Primary Examiner*—Stephen F. Husar

*Attorney, Agent, or Firm*—Wood, Phillips, VanSanten, Clark & Mortimer

[57] ABSTRACT

A portable light is provided which is operated and turned on automatically when the light is moved to a vertical or near vertical position and turns off automatically when in a non-vertical position. A highly reliable, sealed a reed switch is operated when an associated magnet moves into proximity. A locking mechanism retains the magnet to prevent operation of the light when not in use. A manually operated, mechanical switch is also provided and uses a metal strip to over ride the magnet/reed switch to allow for selective operation of the light in any position. The light can be used as a flashlight or attached to a cooler lid, car hood, visor attache case and the like to turn on automatically as the attached, hinged device is moved to a vertical or near vertical position.

35 Claims, 2 Drawing Sheets

FIG. 6
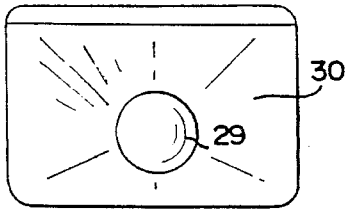
FIG. 7
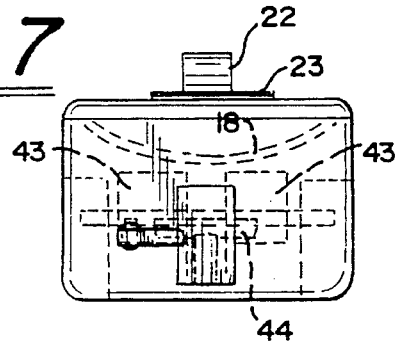
FIG. 8
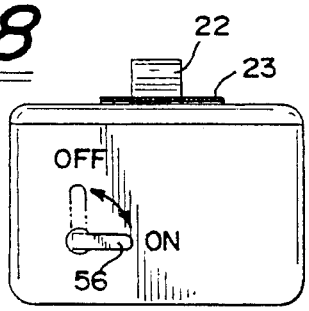
FIG. 9
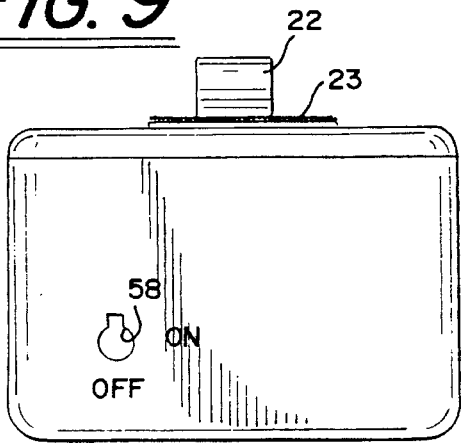
FIG. 10
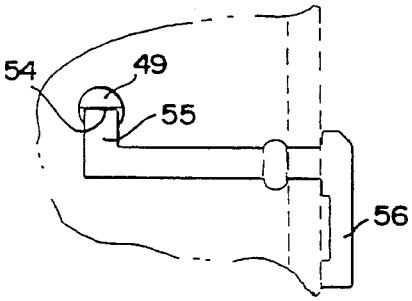
FIG. 11
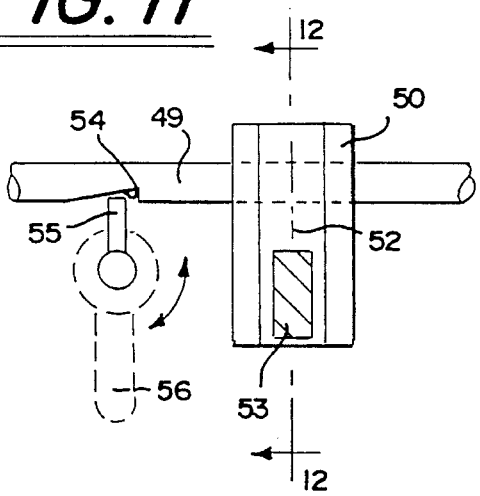
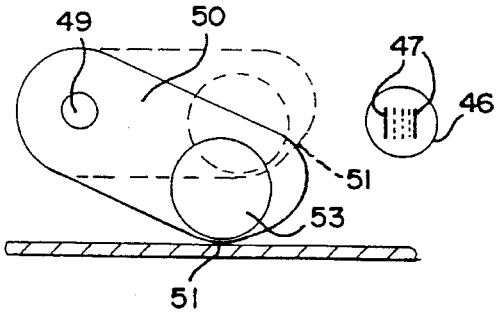
FIG. 12

PORTABLE LIGHTING DEVICE

BACKGROUND OF THE INVENTION

I. Field of the Invention

This disclosure pertains to an automatically operated portable flashlight which may be attached to portable coolers, automobile hoods, visors or any other hinged or movable device were light is occasionally needed.

II. Description of the Prior Art

While the prior art has provided numerous types of portable flashlights and lighting devices for automobiles, insulated containers and the like there has been no product provided for automatic, reed switch, gravity actuated operation in providing illumination.

Prior art devices adapted to automatically illuminate coolers or the inside of automobiles and the like used either permanently installed lights which cannot be removed or removable lights actuated by movable members or mercury switches. These lights which are available or known do not utilize gravity in combination with a magnet and reed switch to directly close contacts in a lighting circuit. A reed switch unlike a mercury switch, will not contaminate the surrounding area if broken.

Once such gravity operating device is shown in the Stansberry, U.S. Pat. No. 4,442,478 (1984) which shows a gravity operating rotating disk mechanically coupled with a spring to actuate a lighting circuit when the container is oriented in a certain position. The problem with this type of device is the contacts are prone to corrosion and contamination and seriously limit the useful life of the device.

Another gravity operated device is disclosed in the Rogers, U.S. Pat. No. 4,755,915 (1988) which shows a light utilized to illuminate the inside of a mailbox. The Rogers device utilizes a mercury switch oriented into a certain direction to illuminate the inside of the mailbox when the mailbox cover is opened. Unlike the current device disclosed herein, utilizing a mercury switch is expensive and if it breaks the mercury will attack and severely weaken aluminum.

Another position oriented operating device for lighting the inside of a automobile is disclosed in the Trattner, U.S. Pat. No. 4,823,241 (1989) which shows a solar operated device also utilizing a mercury switch to connect an operating circuit when the light is oriented in a certain direction. Once again a mercury switch is utilized and because of cost and contamination problems in the event the mercury capsule is broken the instant disclosure provides improvements not heretofore present in the prior art.

One lighting device which discloses a magnetically responsive switch is shown in the Bates, U.S. Pat. No. 3,229,084 (1966). This device is essentially a sealed flashlight unit which has waterproofing features. Although the circuit actuating switch is magnetically activated the Bates disclosure does not use or suggest the use of a sealed reed switch as it is utilized by the instant disclosure used in combination with a gravity operated orientation feature.

SUMMARY OF THE INVENTION

This disclosure pertains to a device used as a portable flashlight which may De adapted to illuminate the inside of automobiles and containers such as portable coolers, fishing tackle boxes and the like. The light may also be attached to a hat or head gear and will remain inoperable or off until the wearer leans downwardly at which time the light is turned on. The lighting device functions to automatically illuminate the inside of a container when the attached, hinged lid or cover is moved between a horizontal and vertical position. Because the light turns off automatically when the lid is closed, the visor raised or the car hood closed, the problem of encountering a burned out battery caused by inadvertently forgetting to turn off the light is eliminated. A mechanical lock is also provided to disable the automatic operating feature if needed for example during shipping or transport. A selectively operable, manual operating switch is also provided to override the reed switch and allow the light to be used as a conventional flashlight and operated on demand while in any position.

The basic version provides the feature of turning on when in a vertical position and off when in a horizontal position. Thus when attached to a visor in an automobile and disposed in a horizontal or near horizontal position the light is off. However, when the visor is rotated into a vertical position the light automatically turns on to illuminate the adjacent area. Similarly, when attached to an automobile hood or the lid of a cooler as the hood is raised or the cooler lid is raised the light turns on automatically and will turn off automatically when the attached, hinged hood or lid is returned to a horizontal position.

A reed switch is used with a moving magnet which comes into proximity with the reed switch to close the switch contacts and actuate a lighting circuit.

It is thus an object of this disclosure to show an improved portable flashlight which is gravity operated and may be attached to a movable member to automatically illuminate the adjacent area as the movable member is moved to a vertical or near vertical position.

It is yet another object of this disclosure to provide a flashlight having a reed switch which operates in series with batteries and a light to turn the light on and off in response to the distance the magnets is spaced from the reed switch.

Another object of this disclosure is to provide a gravity activated source of illumination utilizing a movable magnet and reed switch with a locking mechanism which also functions as an on off switch by capturing the magnet to thus prevent the magnet from moving into proximity with the reed switch and causing the light to be illuminated.

Another object of this disclosure is to provide a gravity operated light using a selectively operable switch having a metal strap which bridges terminals connected to the reed member to allow the light to be operated as required.

Another object of this disclosure is to provide a portable lighting device having a clip attached thereto to allow the flashlight to be easily attached to a hinged or movable member and thus turn off and on as the movable member moves from a horizontal to vertical position.

These and other objects of this disclosure will become apparent to those having ordinary skill in the art with reference to the following descriptions, drawings, and the pending claims.

BRIEF DESCRIPTIONS OF THE DRAWINGS

FIG. 6 is an end view of lamp and reflector;

FIG. 7 is a view taken along line 7—7 of FIG. 5 of internal automatic switching mechanism;

FIG. 8 is a back view of the external housing taken along lines 8—8 of FIG. 4 showing the permanent on/off switch;

FIG. 9 is an enlarged view similar to FIG. 8 and shows the external housing minus the on/off switch, but exposing the external keyhole which the permanent on/off switch snaps into;

FIG. 10 shows the side view of the permanent on/off switch;

FIG. 11 shows a detailed view of the permanent on/off switch and associated locking members;

FIG. 12 is an enlarged view taken along lines 12—12 of FIG. 11 showing the movable magnet, housing and related members.

DESCRIPTION OF THE PREFERRED EMBODIMENTS

Figure 1:
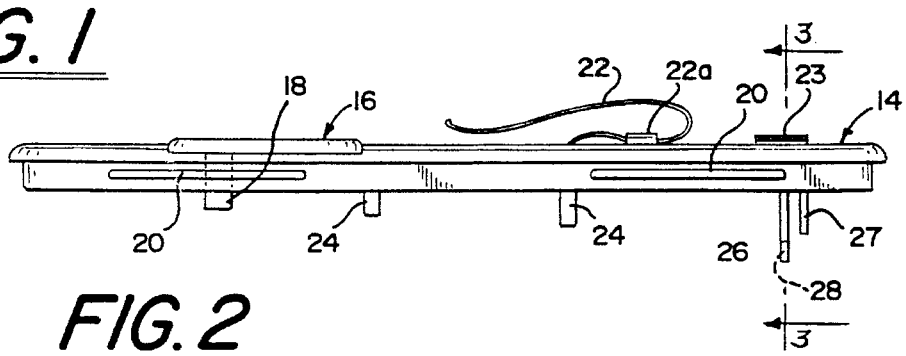
FIG. 1 is an illustration of the cover, incorporating a mechanical switch.
Figure 4:
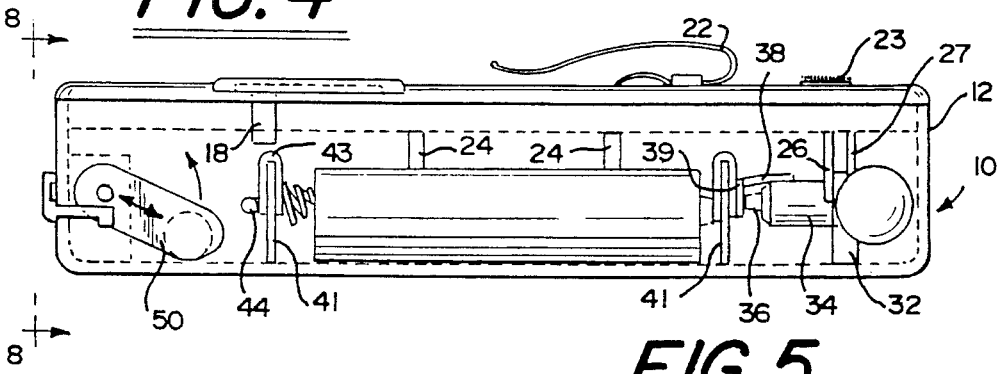
FIG. 4 is a side elevation view, with portions removed, of the internal parts of light.
Figure 5:
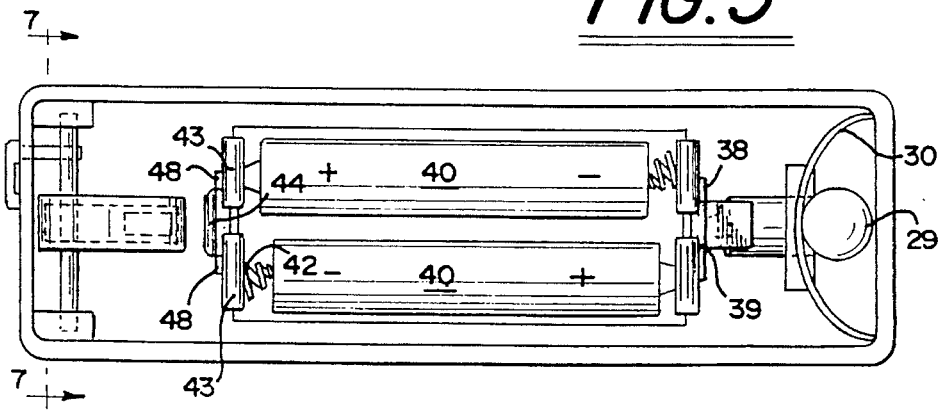
FIG. 5 is a top plan view of internal parts of light.

Referring now to the drawings the preferred embodiment of this disclosure will be described. In FIG. 4 is shown the assembled housing with one side removed to allow the internal components to be fully shown. In particular, the portable light is designated generally by the numeral 10 and consists of a main housing 12 surrounding the internal components and having an open top which is closed off by a cover 14 (FIG. 1). The cover 14 is contemplated as being a rigid plastic molded piece having an opening therein covered by a resilient pad or button 16. A curved metal strip 18 is attached to the underside of the resilient button 16 and thus as the button 16 is depressed the attached metal strip will be lowered as the button is urged downwardly and will automatically be retracted when pressure is removed. A more complete operation of this metallic strip and button will be given later with reference to the operation of this device. The cover 14 also includes a number of slightly raised ridges 20 along the edges thereof which allow the cover 14 to be snapped into the lower housing unit 12. A metallic clip 22 or Velcro 23 is provided on cover 14 to allow the device to be attached into a position for use or storage. The clip 22 may be removably attached through strap **22*a*** and thus be mounted in two directions as needed to direct light.

On the underside of the cover 14 are a number of battery hold down posts 24, and lamp retainers 26 and 27. The lamp retainer 26 has a curved cutout portion 28 allowing it to fit over the lamp 29. A reflector 30 surrounds the lamp 29 for the purpose of concentrating light and distributing light from the bulb and includes a lamp socket 32 into which the lamp 29 is securely fitted. Lamp 29 has a shank side portion 34 and a tip 36 for electrical connections to be made to produce current to the filament of the lamp.

Lamp contacts 38, 39 connect the lamp 29 with batteries 40 which are aligned between posts 41. Springs 42 assist in holding the batteries 40 in place. Contact clips 43 are attached to their respective posts 41 and provide a mounting part for reed switch 44.

The reed switch 44 includes a glass envelope or tube 46 into which a pair of thin metallic reed members 47 are mounted. The reeds 47 are securely attached at each end of the tube 46 and have free ends which move in a cantilever fashion to open and close as a magnet is brought into proximity. Extending from the reed elements 47 and outwardly of the glass envelope 46 are reed leads 48. These leads 48 are mounted into a associated contact clips 43. Thus it is shown that the reed switch 44 is mounted in the circuit to act as a switch to provide battery current to the lamp 29 when the reeds 47 come into contact with one another.

In order to cause the reed elements to move together a magnetic field must be provided. Thus pendulum member 50 is attached to a shaft 49 in such a fashion to freely swing about the shaft 49. The pendulum 50 has a hollow chamber 52 into which a disc like magnet 53 is located. Pendulum member 50 has a modified oval shape wherein the far end which contains the magnet and is shown in FIG. 12 is not completely circular but has somewhat of a tapered end providing a valley 51 into which the magnet nests when the portable light 10 is in a horizontal or somewhat horizontal position. Thus it can be noticed with reference to FIG. 12 that as the device tends to turn in a clockwise, vertical direction the magnet 53 moves rapidly towards the tip of the pendulum 50 and into proximity with reed switch 46 even before any angular movement of the pendulum occurs. Thus any slight angular movement of the pendulum 50 brings the magnet 53 immediately into a zone which closes the reed members 47 and completes the lighting circuit.

The device may be locked in such a fashion that the light can not be inadvertantly actuated even if placed in a vertical or somewhat vertical position. This is accomplished by providing the shaft 49 with a notch 54. A locking finger 55 is adapted to move into the cutout 54 to prevent movement of the shaft 49 and the attached pendulum 50 locking finger 55 is attached to an external handle 56 which allows the operator to move the handle between the off and on position as desired (FIG. 9). A keyhole opening 58 provided in one end to allow the locking arrangement to be mounted.

Thus it has been shown by the foregoing description that a gravity operated light is provided. Upon movement of the light from the horizontal position as shown in FIG. 4 and FIG. 12, the disc shaped magnet 53 rotates to the tip of the pendulum 50 and upon only slight angular movement of the pendulum produces a magnetic field into which the reed member 47 are located causing them to be attracted, drawn together in contact to operate the lamp circuit. When the light is moved from the vertical position the magnet moves away from the reed switch and the light is turned off.

In the event it is desirable to use the light for other than automatic operation in the vertical position as just described the resilient button 16 and the associated metal member 18 comes into operation. By depressing the resilient member 16 the metallic strip 18 makes an electrical contact between the reed switch contact clips 43 (FIG. 7) and closes the circuit to provide electricity to the lamp. This metal strip essentially bridges the contacts 43 replacing the reed switch to complete the electrical connection across the battery and provide illumination. When manual pressure is removed from the resilient button 16 the metal strip 18 moves away from the metal clip 43 and the light is turned off.

Figure 2:
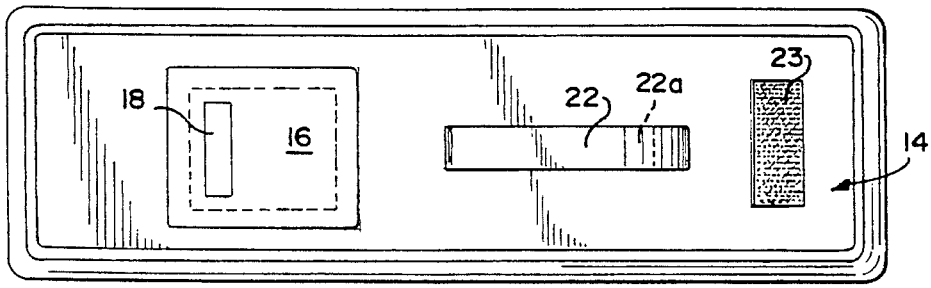
FIG. 2 is a top view of cover showing the mechanical switch consisting of a rubber pad with a metal strip attached to the inside of the cover.
Figure 3:
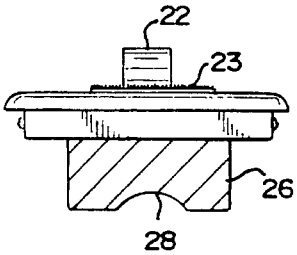
FIG. 3 is a section view of the cover taken along lines 3—3 showing the front bulb position holder.

Thus it is shown by the foregoing that the portable lighting device that is described herein functions as a portable flashlight which can be easily operated by the user merely by activating the manual button 16 or by moving a device from a horizontal to a non-horizontal position. With use of the clip 22 or other type of attaching device such as Velcro or other loop and hook means 23 (FIG. 2). The light can be attached to an inside visor of an automobile, a trunk lid, the hinge top of a cooler, or the like to provide illumination when the hinged device to which it is attached moves into a vertical or non-horizontal position. As the attached device, lid, cover, etc. is lowered to a horizontal or non vertical position the magnet 53 moves away from the reed switch 44 to de-energize the electrical circuit causing the light to go out. This device can also be adapted for other purposes such as the attachment to a fisherman's hat or head piece used by watchmakers and engravers or other people doing close work who do not need constant light but light on demand when they lower their heads for searching items in the dark or doing close work.

By utilizing a reed switch problems associated with contact contamination through oxidation exposure or to corrosine chemicals or damaged was eliminated. If the reed switch malfunctions it is easily replaced because it is of a sub-assembly mounted into clips which can be easily removed without extensive piece work.

By providing the locking function the portable light can be easily shipped with batteries without the risk of the light going on inadvertently during transit. Similarly, if the light is attached to the visor or a portable cooler and the visor or cooler is moved during the daytime when it is not needed the light has a locking capability to prevent movement of the magnet and prevent operation of the light thereby extending battery life.

The foregoing descriptions and drawings merely explain and illustrate the invention and the invention is not limited thereto except insofar as the appended claims are so limited. Those who are skilled in the art having the disclosure before them will be able to make modifications and variations therein without departing the scope of the invention.

What is claimed is:

1. A lighting device adaptable for mounting on a device such as a container having a lid movable between an open or vertical position and a closed or horizontal position, the improvement comprising:

a light bulb for providing illumination and having light control switch means in an electrical circuit with a battery and with the light bulb to turn said light bulb on and off;

said switch means having magnetic gravity responsive means operable to actuate said electrical circuit to automatically turn on said light bulb when in an on position and turn off the light bulb in an off position.

2. The lighting device of claim 1 wherein said electrical circuit further includes:

a first switch with a pair of closely spaced, electrically conductive members in proximity with the magnetic gravity responsive means to be brought into contact with each other and complete the circuit to light the light bulb by the magnetic gravity responsive means when the lighting device is in one position, and to open the circuit and turn off the light bulb when the magnetic gravity responsive means is moved away when the lighting device is in another position.

3. The lighting device of claim 2 wherein the closely spaced, electrically conducting members of said first switch further includes:

a pair of reeds in a glass envelope.

4. The lighting device of claim 2 wherein the magnetic gravity responsive means includes:

a magnet mounted in a guide housing in which the magnet is mounted for movement between a first position when the lighting device is in the off position to a second position closer to the electrically conducting members when the lighting device is in the on position.

5. The lighting device of claim 4 wherein the guide housing includes:

a pendulum having a shaft for allowing swinging movement of the pendulum from a position away from the electrically conducting members when the light bulb is off to a position closer to the electrically conducting members when the lighting device is in the on position.

6. The lighting device of claim 5 wherein the pendulum further includes:

a chamber for allowing limited movement of the magnet as the lighting device moves between a horizontal and vertical position.

7. The lighting device of claim 6 wherein the chamber provided by the pendulum further includes:

a nose portion limiting the furthest movement of the magnet;

a valley portion spaced from the nose portion and having a connected ramp joining the valley portion with the nose portion whereby the magnet is allowed to return to the valley portion and away from the electrically conducting members when the lighting device is in the off position.

8. The lighting device of claim 1 wherein said electric circuit further includes:

second switch means for manually lighting said light bulb and providing a pair of contacts in parallel with the first switch means and having a manually actuated button means with a conducting member movable in response to movement of the button means to make electrical contact with the circuit means for selective operation of the light means.

9. A lighting device adaptable for use as a flashlight and adaptable for mounting the lighting device on a device such as a container having a lid movable between an open or vertical position and a closed or horizontal position, the improvement comprising:

a light bulb for providing illumination and having light control switch means in an electrical circuit with a battery and with the light bulb to turn said light bulb on and off;

said switch means having gravity responsive means operable to actuate said electrical circuit to automatically turn on said light bulb when in one position and turn off the light bulb in another position; and a cutout switch having a manually movable handle and a locking finger for engaging the gravity responsive means to prevent movement of the gravity responsive means and allow the lighting device to be used as a manually operated flashlight.

10. The lighting device of claim 1 wherein the lighting device includes:

loop and hook connecting means.

11. The lighting device of claim 1 wherein the lighting device includes:

a resilient clip means.

12. The lighting device of claim 4 wherein the guide housing includes a chamber for allowing limited movement of the magnet as the lighting device moves between a horizontal and vertical position, the chamber defining a path for movement of the magnet, the path being oriented so that the magnet may move toward the electrical conducting members when the device is out of the off position and away from the electrical conducting members when the device is in the off position.

13. The lighting device of claim 12 wherein the chamber defining the path includes:

a nose portion limiting the furthest movement of the magnet, the nose portion defining the part of the path closest to the electrical conducting members;

a valley portion spaced from the nose portion and having a connected ramp joining the valley portion and the nose portion whereby the magnet is allowed to return to the valley portion and away from the electrically conducting members when the lighting device is in the off position.

14. The lighting device of claim 4 wherein said electric circuit further includes:

second switch for manually lighting said light bulb and providing a pair of contacts in parallel with the first switch means and having a manually actuated button means with a conducting member movable in response to movement of the button means to make electrical contact with the circuit means for selective operation of the light means.

15. The lighting device of claim 13 wherein said electric circuit further includes:

second switch for manually lighting said light bulb and providing a pair of contacts in parallel with the first switch means and having a manually actuated button means with a conducting member movable in response to movement of the button means to make electrical contact with the circuit means for selective operation of the light means.

16. The lighting device of claim 4 wherein the guide housing allows for both linear and swinging movement of the magnet toward and away from the electrical conducting members.

17. The lighting device of claim 16 wherein the guide housing includes a pendulum having a shaft and a free end, the pendulum being mounted for swinging movement of the shaft from the first position wherein the free end of the pendulum is closer to the electrical conducting members to the second position wherein the free end of the pendulum is farther from the electrical conducting members, the pendulum including a chamber in which the magnet is held, the chamber including a nose portion limiting the furthest movement of the magnet and a valley portion spaced from the nose portion and having a connecting ramp joining the valley portion and the nose portion, the nose portion being positioned at the free end of the pendulum, whereby the magnet is allowed to return to the valley portion and away from the electrically conducting members when the lighting device is in the off position, the chamber providing for linear movement of the magnet and the pendulum providing for swinging movement of the magnet;

the lighting device further comprising a cutout switch having a manually movable handle and a locking finger means for preventing movement of the pendulum to prevent actuation of the electrically conducting members to thereby maintain the light bulb in an off mode.

18. The lighting device of claim 17 further comprising:

second switch for manually lighting said light bulb and providing a pair of contacts in parallel with the first switch means and having a manually actuated button means with a conducting member movable in response to movement of the button means to make electrical contact with the circuit means for selective operation of the light means.

19. The lighting device of claim 1 wherein said switch means is operable to actuate said electrical circuit to automatically turn on said light bulb when the lighting device is in a position intermediate the horizontal and vertical positions.

20. The lighting device of claim 4 wherein the electrically conducting members are in proximity with the gravity responsive means so that the electrically conducting members are brought into contact with each other to complete the circuit to light the light bulb when the lighting device is in a position intermediate the horizontal and vertical positions.

21. The lighting device of claim 1 wherein the off position is the horizontal position and the on position is the vertical position.

22. The lighting device of claim 1 wherein the on position is the horizontal position and the off position is the vertical position.

23. A lighting device adaptable for mounting in different orientations on device surfaces movable to vertical and horizontal positions, the lighting device comprising:

a light bulb for providing illumination;

a battery;

a light control switch in an electrical circuit with the battery and the light bulb; and gravity responsive means operable to actuate said light control switch to automatically turn on said light bulb when the lighting device is in an on position and to turn off said light bulb when said lighting device is in an off position;

wherein said light control switch and gravity responsive means are operable so that when the lighting device is oriented in one direction the light bulb is on when the lighting device is vertical and so that when the lighting device is oriented in another direction the light bulb is off when the lighting device is vertical;

wherein said light control switch includes a pair of closely spaced electrical conductors and wherein said gravity responsive means includes a pendulum having a shaft for allowing swinging movement of the pendulum from a position away from the pair of closely spaced electrical conductors to a position closer to the pair of closely spaced electrical conductors.

24. The lighting device claimed in claim 23 wherein said lighting device includes a housing in which the light bulb, battery, light control switch and gravity responsive means are held, the housing having a pair of spaced parallel exterior faces, and a windowed face perpendicular to the spaced parallel faces with the light bulb proximate to said windowed face, the lighting device being capable of being oriented with either of the spaced parallel exterior faces facing the device surface, the light control switch and gravity responsive means being operable so that when one exterior face is facing the device surface, the light bulb is on when the lighting device is vertical and the windowed face is facing downward and so that when the other exterior face is facing the device surface, the light bulb is off when the lighting device is vertical and the windowed face is facing upward.

25. The lighting device claimed in claim 23 wherein said pendulum has a chamber including a nose portion at the free end of the pendulum and a valley portion spaced from the nose portion and having a ramp joining the valley portion with the nose portion, wherein the nose portion is closer to the electrical conductors than the valley portion.

26. A lighting device adaptable for mounting in different orientations on device surfaces movable to vertical and horizontal positions, the lighting device comprising:

a light bulb for providing illumination;

a battery;

a light control switch in an electrical circuit with the battery and the light bulb; and magnetic gravity responsive means operable to actuate said light control switch to automatically turn on said light bulb when the lighting device is in an on position and to turn off said light bulb when said lighting device is in an off position;

wherein said light control switch and gravity responsive means are operable so that when the lighting device is oriented in one direction the light bulb is on when the lighting device is vertical and so that when the lighting device is oriented in another direction the light bulb is off when the lighting device is vertical.

27. The lighting device claimed in claim 25 wherein said light control switch includes a pair of closely spaced electrical conductors and wherein said magnetic gravity responsive means includes a magnet mounted for movement between a first position wherein the electrical conductors are in contact and a second position spaced farther from the electrical conductors wherein the electrical conductors are out of contact so that said light bulb is on when the lighting device is in one position and off when the lighting device is in another position, the movement of the magnet being in response to the position of the lighting device.

28. The lighting device of claim 27 wherein said pair of electrical conductors comprises a pair of reeds in a glass envelope.

29. The lighting device of claim 27 wherein said guide housing comprises a pendulum having a shaft for swinging movement of the magnet toward and away from the conductors, the pendulum having a chamber providing a second path of movement.

30. The lighting device of claim 29 wherein said guide housing chamber includes a nose portion limiting the furthest movement of the magnet, and a valley portion spaced from the nose portion and having a ramp joining the valley portion, the nose portion being positioned between the valley portion and the conductors, the second path of movement being from the nose portion to the valley portion along the ramp.

31. A lighting device for mounting on device surfaces movable to vertical and horizontal positions, the lighting device comprising:

a light bulb for providing illumination;

a battery;

a light control switch in an electrical circuit with the battery and the light bulb, the light control switch including a pair of closely spaced electrical conductors;

a guide housing;

a magnet mounted in the guide housing and movable between positions closer to and further away from the closely spaced electrical conductors, said electrical conductors completing the electrical circuit to light the light bulb when the magnet is in the closer position, said magnet being movable within said guide housing between said closer and further positions in response to a change in position of the lighting device.

32. The lighting device of claim 31 wherein said guide housing provides a substantially planar path of movement for the magnet between the closer and further positions.

33. The lighting device of claim 31 wherein said guide housing comprises a pendulum mounted on a shaft to swing between said closer and further positions.

34. The lighting device of claim 32 wherein said guide housing is mounted on a shaft to swing between said closer and further positions.

35. The lighting device of claim 31 wherein said light control switch comprises a reed switch.

* * * * *